US007600491B2

(12) United States Patent
Negoro et al.

(10) Patent No.: US 7,600,491 B2
(45) Date of Patent: Oct. 13, 2009

(54) COOLANT AIR BLEED STRUCTURE FOR WATER-COOLED INTERNAL COMBUSTION ENGINE AND ENGINE INCORPORATING SAME

(75) Inventors: Masaaki Negoro, Saitama (JP); Yuji Kashiwabara, Saitama (JP); Kazuyuki Nakai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 48 days.

(21) Appl. No.: 11/895,060

(22) Filed: Aug. 23, 2007

(65) Prior Publication Data

US 2008/0053385 A1 Mar. 6, 2008

(30) Foreign Application Priority Data

Aug. 31, 2006 (JP) ..... 2006-236095

(51) Int. Cl.
*F01P 1/06* (2006.01)

(52) U.S. Cl. ..... 123/41.54; 123/41.08

(58) Field of Classification Search ..... 123/41.54, 123/41.1, 41.08, 41.09, 41.44, 41.82 R, 41.74, 123/41.31; 165/104.32, 110, 41, 51; 236/34.5
See application file for complete search history.

(56) References Cited

U.S. PATENT DOCUMENTS

| | | | | |
|---|---|---|---|---|
| 4,643,134 | A * | 2/1987 | Schnizlein | 123/41.1 |
| 4,984,538 | A * | 1/1991 | Nanba | 123/41.1 |
| 5,836,272 | A * | 11/1998 | Sakurai | 123/41.82 R |
| 5,970,928 | A * | 10/1999 | Smietanski et al. | 123/41.54 |
| 5,992,481 | A * | 11/1999 | Smith | 141/326 |
| 6,843,209 | B2 * | 1/2005 | Miyagawa et al. | 123/41.1 |
| 7,261,069 | B2 * | 8/2007 | Gunther | 123/41.54 |

FOREIGN PATENT DOCUMENTS

JP 01-160119 11/1989

* cited by examiner

*Primary Examiner*—Noah Kamen
(74) *Attorney, Agent, or Firm*—Carrier, Blackman & Associates P.C.; William D. Blackman; Joseph P. Carrier

(57) ABSTRACT

A coolant air bleed structure is provided for a water-cooled internal combustion engine having a plurality of cylinders and a cylinder head, formed at upper portion of the cylinders. The cylinder head includes a coolant jacket formed therein. The coolant air bleed structure is disposed in an air bleed hole formed in a protrusion formed at a substantially central vertical portion of a sidewall of the cylinder head. The coolant air bleed structure is operatively connected to the coolant jacket, and includes a jiggle valve which is configured to open during a coolant changing operation.

19 Claims, 7 Drawing Sheets

COOLANT AIR BLEED STRUCTURE FOR WATER-COOLED INTERNAL COMBUSTION ENGINE AND ENGINE INCORPORATING SAME

CROSS-REFERENCE TO RELATED APPLICATIONS

The present application claims priority under 35 USC §119 based on Japanese patent application No. 2006-236095, filed on Aug. 31, 2006. The entire subject matter of this priority document is herein incorporated by reference.

BACKGROUND OF THE INVENTION

1. Field of the Invention

The present invention relates to a coolant air bleed structure for a water-cooled internal combustion engine and to an engine incorporating same. More particularly, the present invention relates to disposition of a coolant air bleed structure in a water-cooled internal combustion engine having a plurality of cylinders.

2. Description of the Background Art

A number of coolant air bleed structures for an internal combustion engine, including disposition thereof in the engine, are known. An example of disposition of coolant air breed structure in a water-cooled internal combustion engine is disclosed in the Japanese Utility Model Laid-open No. Hei 1-160119.

According to the Japanese Utility Model Laid-open No. Hei 1-160119, the coolant air bleed structure includes an air bleed member disposed in a coolant pipe situated in a top (upper) portion of an engine cylinder head; and the engine coolant system is bled of air using the air bleed member disposed at the top portion of the cylinder head.

When the water-cooled internal combustion engine includes the coolant air bleed structure as described in the Japanese Utility Model Laid-open No. Hei 1-160119, it is necessary to loosen (or screw out) a bolt of the air bleed member to allow air bleeding from the cooling system during the coolant changing (replacing) operation. Such loosening of the bolt of the air bleed member during routine maintenance of the engine, i.e., replacing/flushing of the coolant disadvantageously requires more time and results in poor serviceability of the engine.

Moreover, the air bleed member of the Japanese Utility Model Laid-open No. Hei 1-160119, is disposed at a top (upper) portion, e.g., crown portion of the cylinder head. In other words, according to the Japanese Utility Model Laid-open No. Hei 1-160119, the air bleed member is not disposed in the sidewalls of the cylinder head. Such disposition of the air bleed member at the upper (crown) portion of the cylinder head does not allow building the engine compactly vertically, and also results in poor appearance of an engine body.

The present invention has been made to address the foregoing problems. Accordingly, it is an object of the present invention to provide a coolant air bleed structure for a water-cooled internal combustion engine which offers good serviceability, enhances compactness of the engine body, and improves appearance thereof.

SUMMARY OF THE INVENTION

In order to achieve the foregoing object, the present invention according to a first aspect provides a coolant air bleed structure for a water-cooled internal combustion engine disposed at a cylinder head of the engine. The water-cooled internal combustion engine includes a cylinder, a cylinder head formed at an upper portion of the cylinder, a water jacket formed within the cylinder head, and an air bleed member disposed in the sidewall of the cylinder head and operatively connected to the water jacket. The air bleed member is configured to discharge air from the water jacket. In the coolant air bleed structure of the present invention, the air bleed member includes a jiggle valve and is disposed at a vertical central portion of a sidewall of the cylinder head.

The present invention according to a second aspect, in addition to the first aspect, includes the water-cooled internal combustion engine having a plurality of cylinders arranged in line, each of the cylinders having inclined cylinder axis, and a plurality of intake port and exhaust ports respectively disposed on a distal side of an inclination plane direction of the cylinders. Further, the air bleed member is disposed between at least two intake ports; at least two exhaust ports or between intake and exhaust ports.

The present invention according to a third aspect, in addition to the first and second aspects, includes the air bleed member disposed at a protrusion formed on a sidewall of the cylinder head. Additionally, the air bleed member longitudinally extends parallel to an axis of the cylinder head.

ADVANTAGES OF THE PRESENT INVENTION

In the coolant air bleed structure for the water-cooled internal combustion engine according to the first aspect, the jiggle valve of air bleed member opens when air is supplied during a coolant changing procedure to release the air from the coolant system of the engine. This eliminates the need for loosening the bolt, as required by the conventional air bleed member, thus improving serviceability of the engine. When the coolant is thereafter fed in, the air bleed member is closed and remains in a closed position.

Further, the air bleed member is disposed at the vertical central portion of a sidewall of the cylinder head. Thus, in comparison to the conventional air bleed structure in which the air bleed member is disposed at the upper portion of the cylinder head (e.g., crown portion of the cylinder head), the engine can be built compactly vertically, and appearance of the engine can be improved.

In accordance with the coolant air bleed structure for the water-cooled internal combustion engine according to the second aspect, the air bleed member is disposed in a dead space between intake/exhaust ports of the water-cooled internal combustion engine having a plurality of cylinders with the inclined cylinder axis and the plurality of intake or exhaust ports disposed on the distal side of the inclination direction. The air bleed member is therefore disposed in the dead space between the ports, which is less noticeable in terms of appearance and helps promote compactness of the engine.

In accordance with the coolant air bleed structure for the water-cooled internal combustion engine according to the third aspect, the air bleed member is disposed in the protrusion formed on the sidewall of the cylinder head. The air bleed member is disposed such that it longitudinally extends parallel to the axis of the cylinder head. The air bleed member is therefore disposed in a position not protruding from the sidewall of the cylinder head, i.e., the air bleed member does not extend laterally from the sidewall of the cylinder head. With such positioning of the air bleed member further compactness of the engine can be achieved.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE ILLUSTRATIVE EMBODIMENTS

A coolant air bleed structure (also referred as an air bleed member) for a water-cooled internal combustion engine and an engine incorporating same according to an illustrative embodiment of the present invention is described below in detail with reference to the accompanying drawings.

Throughout the following discussion, a "front," a "rear," a "right," and a "left" refer to corresponding directions, i.e., a front/forward direction, a rear direction, a right direction and a left direction, respectively, as viewed from a rider's normal position on the motorcycle during driving of the motorcycle.

Figure 1:
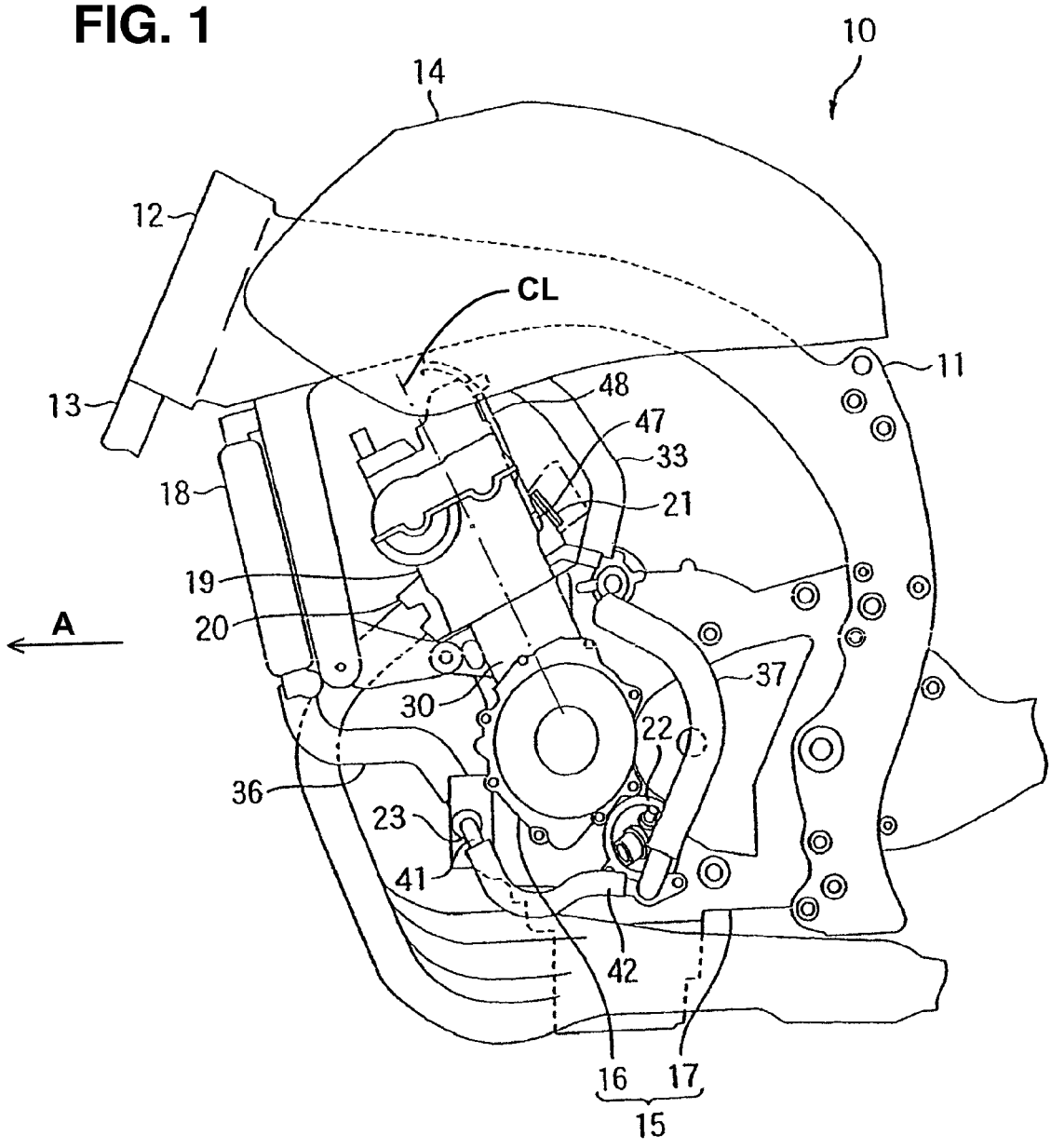
FIG. 1 is a left side elevational view showing an engine and surrounding parts mounted in a motorcycle having a coolant air bleed structure for a water-cooled internal combustion engine according to an embodiment of the present invention.
Figure 2:
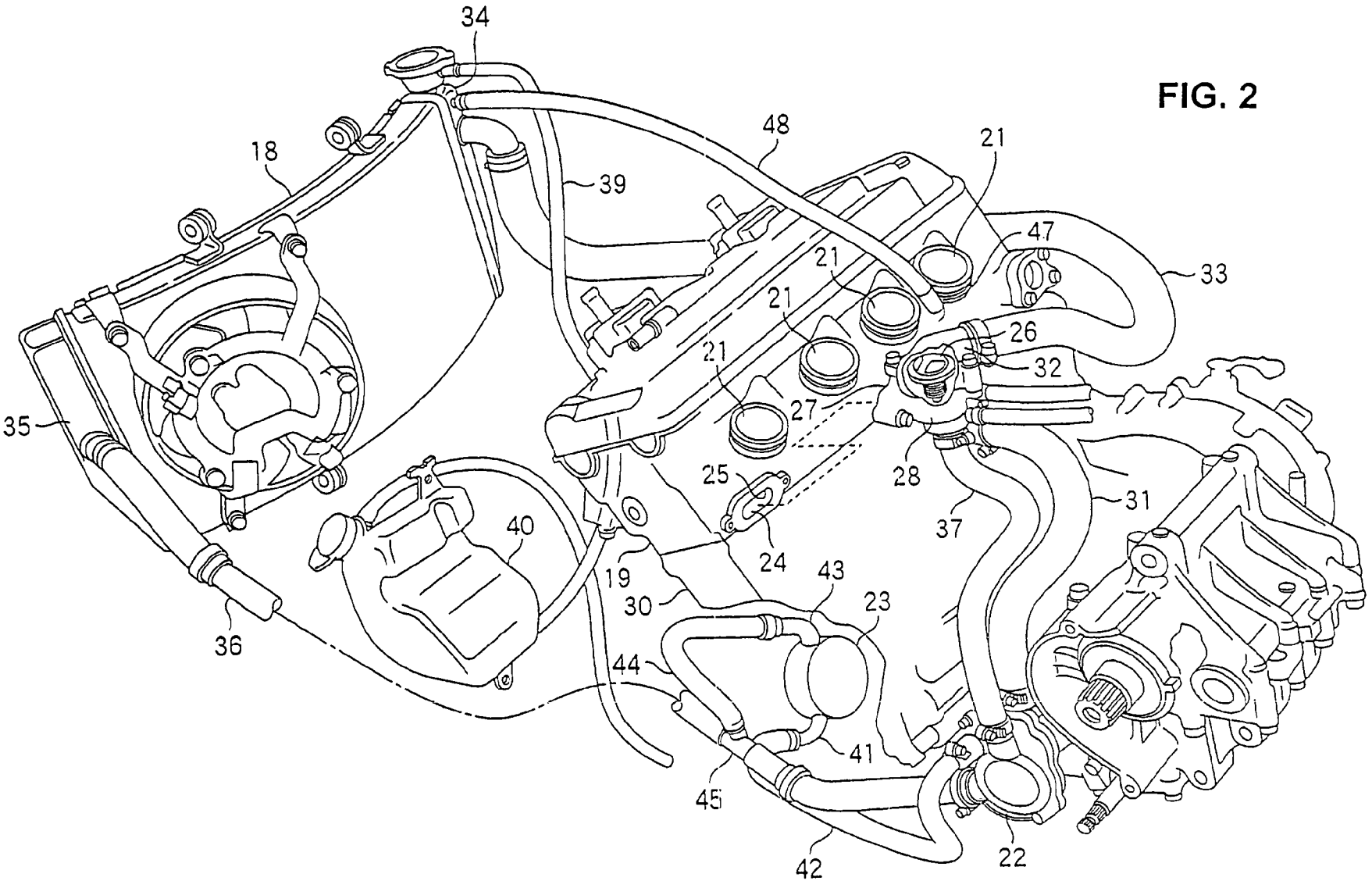
FIG. 2 is a perspective view showing different parts of the motorcycle, including engine thereof shown in FIG. 1, for illustrating a coolant circulating path of the engine.
Figure 3:
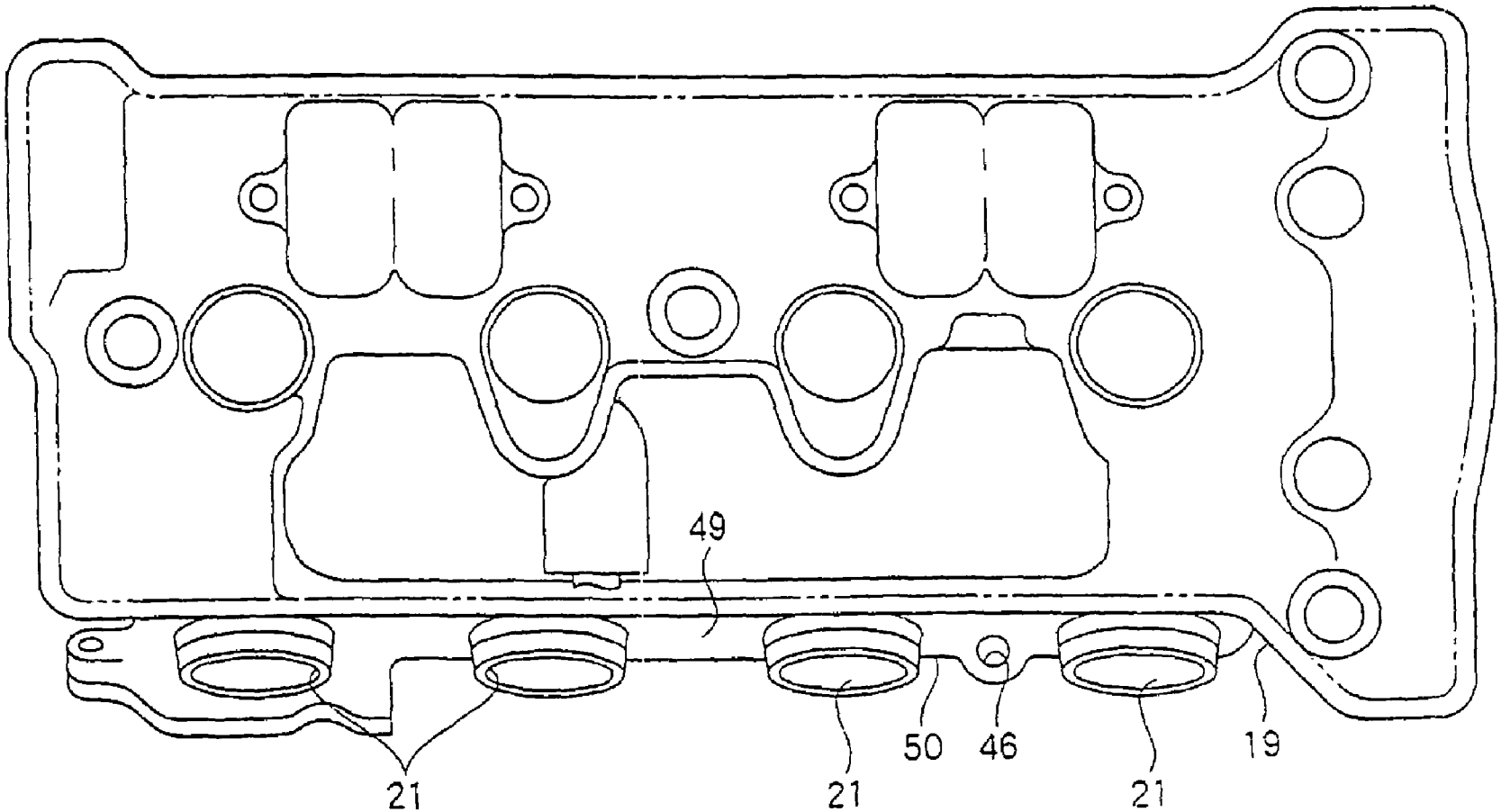
FIG. 3 is a plan view showing the engine of the motorcycle shown in FIG. 1.
Figure 4:
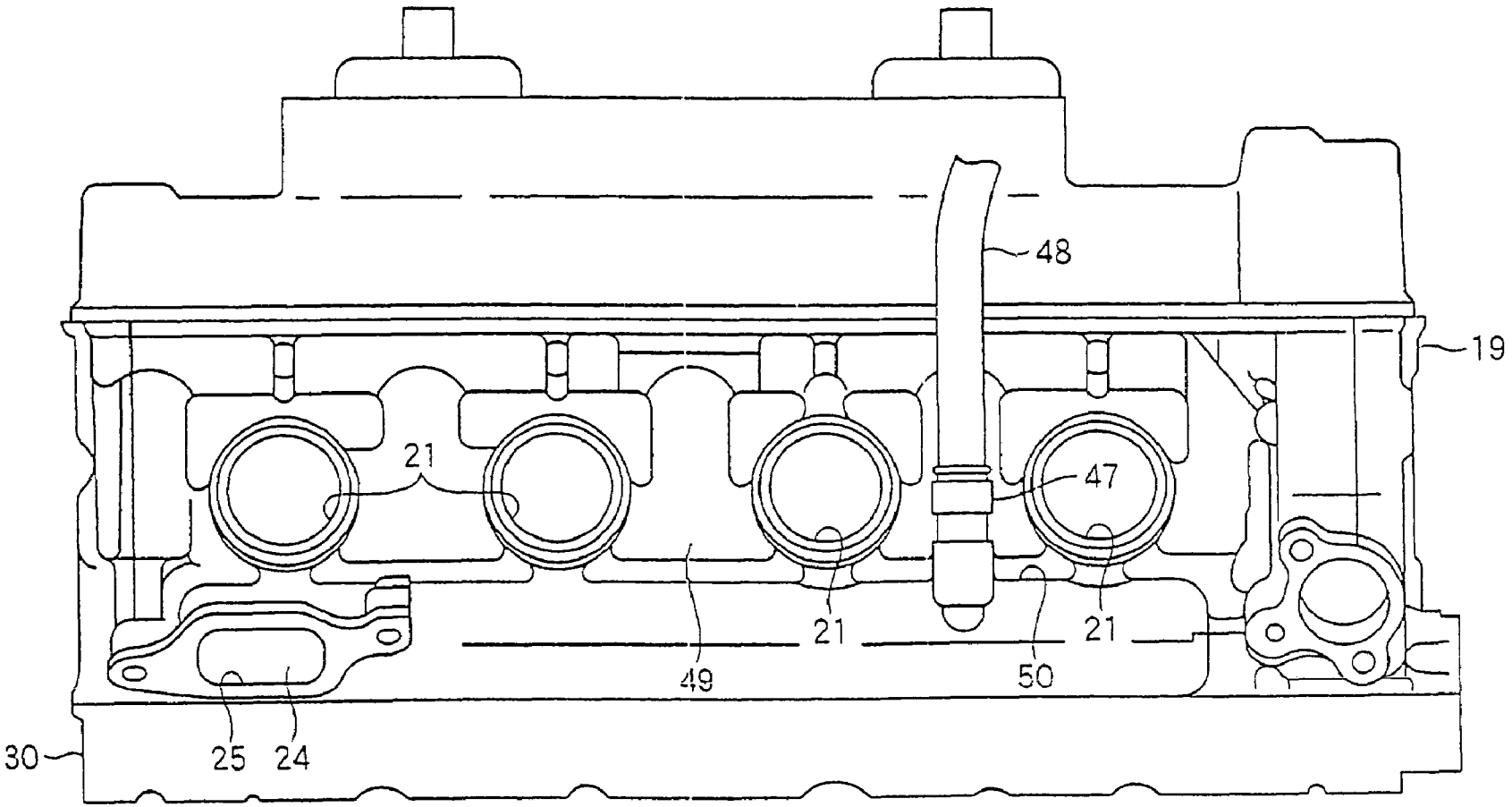
FIG. 4 is a rear elevational view showing the engine shown in FIG. 1 as viewed from an intake port side of the engine.
Figure 5A:
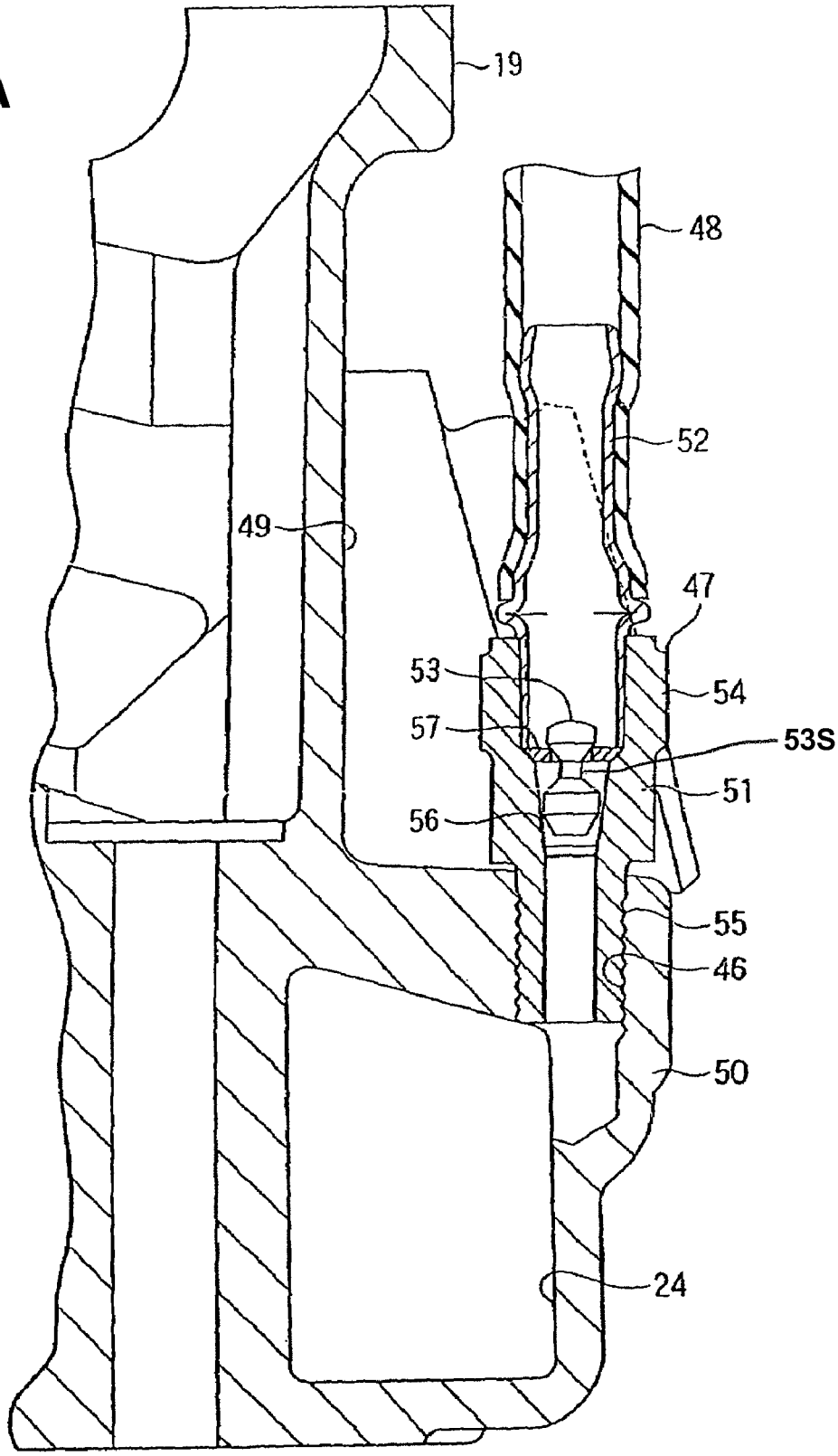
FIG. 5A is a longitudinal cross-sectional view showing an air bleed member and surrounding parts of the engine shown in FIG. 1.
Figure 5B:
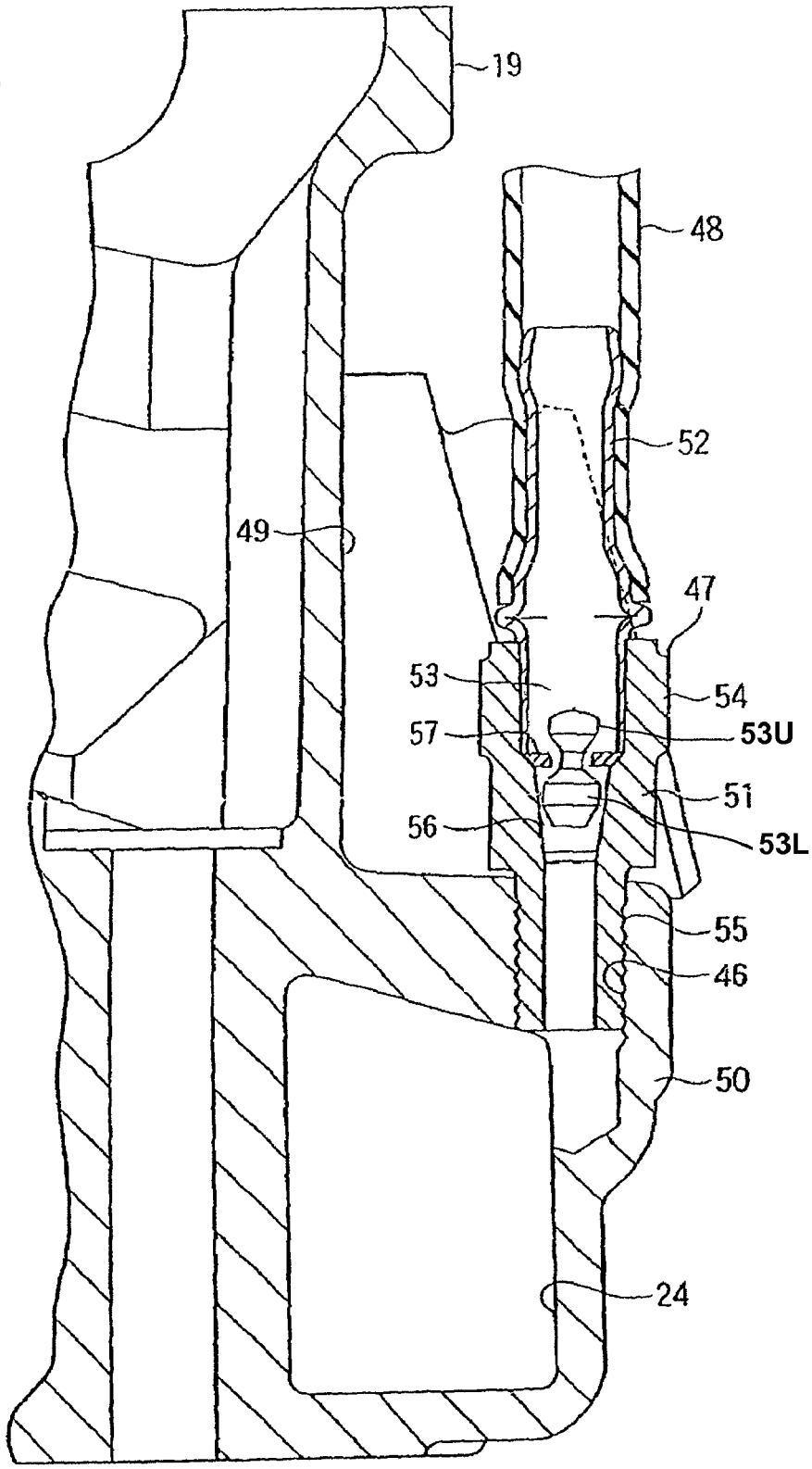
FIG. 5B is a longitudinal cross-sectional view showing an air bleed member, in an Operational state, i.e., open state thereof.
Figure 6:
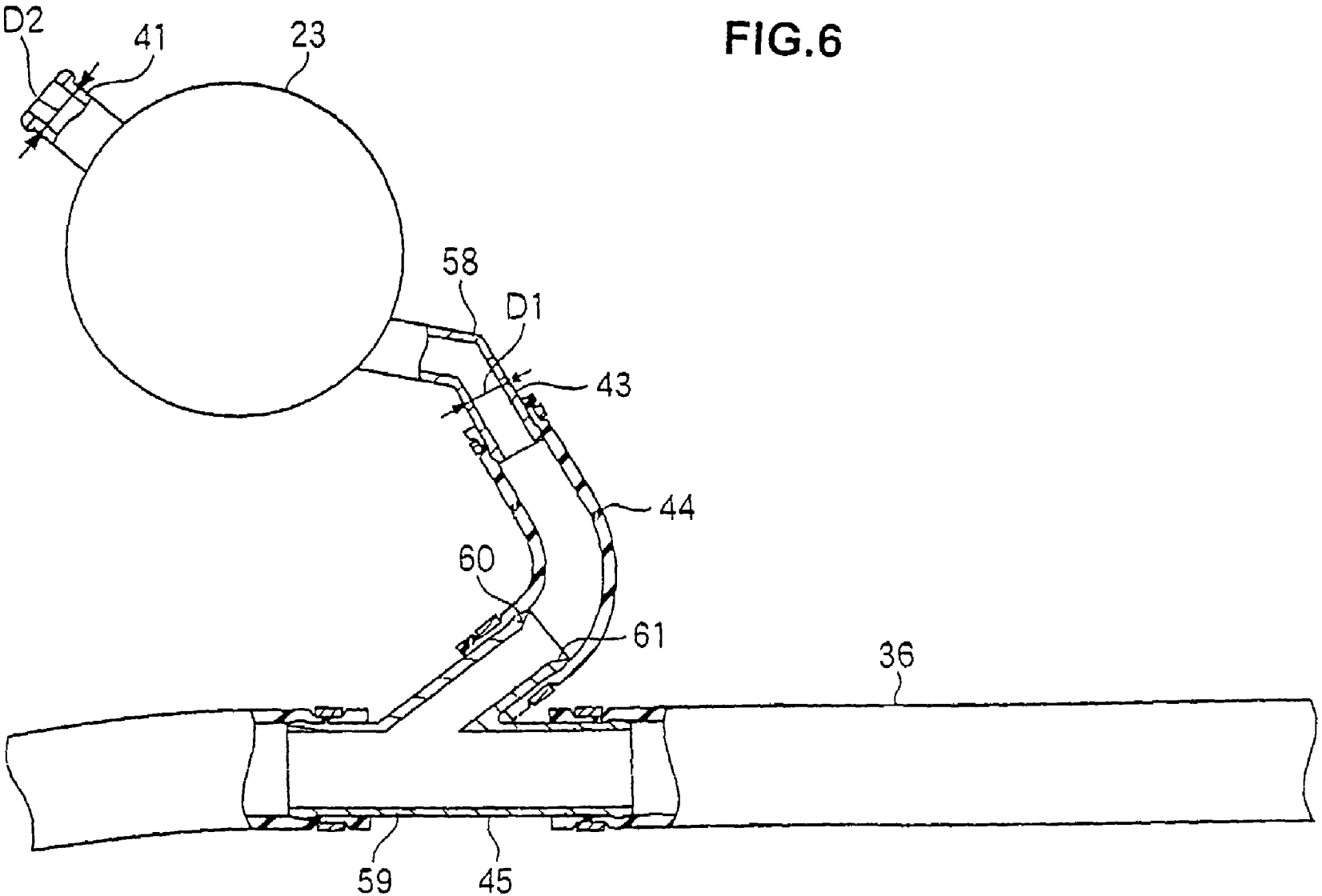
FIG. 6 is a partly cutaway side elevational view showing an oil cooler and surrounding parts of the engine shown in FIG. 1.

FIGS. 1 through 6 are views showing an illustrative embodiment of the present invention. FIG. 1 is a left side elevational view showing an engine and surrounding parts mounted in a motorcycle having the coolant air bleed structure for a water-cooled internal combustion engine according to an embodiment of the present invention. FIG. 2 is a perspective view showing different parts of the motorcycle shown in FIG. 1, for illustrating a coolant circulating path of the engine. FIG. 3 is a plan view showing the engine of the motorcycle shown in FIG. 1. FIG. 4 is a rear elevational view showing the engine shown in FIG. 1 as viewed from an intake port side of the engine. FIG. 5 is a longitudinal cross-sectional view showing an air bleed member and surrounding parts of the engine shown in FIG. 1. FIG. 6 is a partly cutaway side elevational view showing an oil cooler and surrounding parts of the engine shown in FIG. 1.

Referring to FIG. 1, a motorcycle 10 includes, as main components thereof, a main frame 11, a front fork 13, a fuel tank 14, a power unit 15, and a radiator 18. The front fork 13 is mounted on a head pipe 12 disposed at a front end portion of the main frame 11. The fuel tank 14 is mounted at an upper portion of the main frame 11. The power unit 15, which includes an engine 16 and a transmission 17, is mounted at a lower portion of the main frame 11. The radiator 18 is mounted at a lower portion of the main frame 11 at a front portion of the engine 16.

The main frame 11 is formed, for example, of an aluminum alloy casting having a hollow inverted-U shape. The main frame 11 extends downwardly toward the rear from the head pipe 12.

The power unit 15 includes a water-cooled four-stroke, in-line four-cylinder, DOHC four-valve, five-bearing type engine 16 having an electronic fuel injection system. Further the power unit 15 includes a constant-mesh six-speed return transmission 17.

The engine 16 according to an embodiment of the present invention includes a cylinder having a cylinder axis CL inclined forwardly of a vehicle traveling direction shown by an arrow A. The engine 16 is a cross flow type and includes a cylinder head 19, an exhaust port 20 on a forward side of an inclination direction and an intake port 21 on a rearward side of the inclination direction.

The engine 16 according to another embodiment of the present invention includes a plurality of (e.g., four) cylinders, each having a cylinder axis inclined forwardly. The engine 16 is a cross flow type and includes a cylinder head 19, four exhaust ports 20 on a forward side of an inclination direction and four intake ports 21 on a rearward side of the inclination direction.

An intake manifold (not shown) connected to the intake ports 21 of the cylinder head 19 includes a throttle valve having an injector (not shown). Upon providing an electric signal (a current signal or a voltage signal) from an engine control unit (not shown) based on an opening of a throttle lever (accelerator), the injector injects fuel under high pressure into the intake manifold.

Referring to FIG. 2, the engine 16 includes a water pump 22 disposed at a rear lower portion thereof, and an oil cooler 23 disposed at a front lower portion of the engine 16. A lower body 28 of a thermostat housing 27, which accommodates a thermostat 26 therein, is fluidly connected with a coolant outlet port 25 of a water jacket 24 formed in the cylinder head 19. The coolant outlet port opens at a lower portion of the intake ports 21 leftward of the cylinder head 19.

The oil cooler 23 allows coolant to circulate via a desired path, in which the coolant does not directly come in contact with a lubricant that flows through an oil element 29 via an oil gallery (not shown). The water jacket 24 has a circulation path extending from a coolant inlet port (not shown) situated in the cylinder head 19 to the coolant outlet port 25 via outer portion of four cylinders, i.e., cylinder liners (not shown) in a crankcase 30 and an outer portion of a combustion chamber (not shown) of the cylinder head 19.

The thermostat housing 27 is situated at a lower leftward portion of the cylinder head 19. Service jobs on the thermostat can be easily performed when the motorcycle is in parked position since the motorcycle 10 is inclined at a leftward side thereof when the motorcycle 10 is parked using a stand (not shown) disposed on the left side of the motorcycle 10.

An outlet side of the water pump 22 is fluidly connected (i.e., establishes a fluid communication) with a coolant inlet port of the water jacket 24 formed in the cylinder head 19 via a first hose 31. An upper body 32 of the thermostat housing 27 is fluidly connected with an upper tank (upstream side tank) 34 of the radiator 18 via a second hose 33. A lower tank (downstream side tank) 35 of the radiator 18 is fluidly connected with an inlet side of the water pump 22 via third hose 36. The lower body 28 of the thermostat housing 27 is fluidly connected with the inlet side of the water pump 22 via a fourth hose 37.

A siphon tube 39 of the radiator 18 is fluidly connected with a reservoir tank 40 disposed forwardly and on left side of the engine 19.

The oil cooler 23 is connected to a coolant inlet port 41 that is fluidly connected with the outlet side of the water pump 22 via a fifth hose 42. Further, the oil cooler 23 is connected to a coolant outlet port 43 that is fluidly connected with a connector 45, disposed in an approximately midway of the third hose 36, via a sixth hose 44.

As shown in FIG. 3, a bulge 50 (also referred as a protrusion) is formed in the cylinder head 19. The protrusion 50 includes an air bleed hole 46 formed therein. The air bleed hole 46 is formed at an upper end portion of the water jacket 24 between first and second intake ports of the four intake ports 21. A coolant air bleed structure 47 (also referred as an air bleed member) is disposed in the air bleed hole 46. The air bleed member 47 is disposed at a vertical central position on a sidewall of the cylinder head 19. The air bleed member 47 is fluidly connected with the upstream side tank 34 of the radiator 18 via an air bleed tube 48.

In the coolant circulation path, as discussed above, the thermostat 26 is closed when the engine 16 is started cold, and the coolant temperature remains low before engine warm-up. Accordingly, the coolant circulates through the water pump 22, the first hose 31, the water jacket 24 of the cylinder head 19, the coolant outlet port 25, the lower body 28 of the thermostat housing 27, and back in the water pump 22.

When the engine 16 is warmed up with the lapse of time after the engine 16 has been started, the thermostat opens after the coolant temperature reaches a predetermined value (for example, a set predetermined temperature of the thermostat 26 at 70° C. to 85° C.). When the thermostat is in open position, the coolant circulates through the water jacket 24 formed in the cylinder head 19, the coolant outlet port 25, the lower body 28 of the thermostat housing 27, the upper body 32 of the thermostat housing 27, the second hose 33, the upper tank 34 of the radiator 18, the lower tank 35 of the radiator 18, the third hose 36, and the water pump 22, such that the temperature of the coolant in the water jacket 24 is maintained at the predetermined value.

Referring to FIGS. 3 and 4, the air bleed hole 46 disposed between the first and second intake ports of the four intake ports 21 of the cylinder head 19 has a predetermined inside diameter. The air bleed hole 46 is formed vertically in the protrusion 50 slightly protruding rearwardly in a sidewall 49 of a rearward bank of the cylinder head 19. In other words, the air bleed hole 46 is formed less protruding rearwardly than the intake ports 21 are.

Moreover, as it can be seen from FIGS. 3 and 4, the air bleed hole 46 is formed in a dead space between the first and second intake ports of the four intake ports 21. Therefore, the air bleed hole 46 does not interfere with a space for assembling the intake manifold and the like. Further, the arrangement of the air bleed hole 46 formed at a rightward upper end portion of the water jacket 24 in the cylinder head 19 and a rightward side of the cylinder head 19 facilitates service jobs when the motorcycle 10 is parked on a stand leaning leftwardly since the air bleed hole is raised high under such parked condition.

Referring to FIG. 5, the air bleed member 47 includes an engine side connector 51, a tube side connector 52, and a jiggle valve 53.

The engine side connector 51 includes a tube having a nut portion 54, a threaded portion 55, and a hollow portion 56. In order to dispose the air bleed member 47 in the air bleed hole 46, the nut portion 54 is turned with a tool, for example, a wrench or the like. This causes the threaded portion 55 to be screwed into the air bleed hole 46, so that the engine side connector 51 is secured in the cylinder head 19, as shown in FIG. 5.

The tube side connector 52 is formed into a cylinder integrated with an inside of the nut portion 54. The air bleed tube 48 is externally fitted over the tube side connector 52.

In the depicted embodiment, as shown in FIGS. 5A and 5B, the jiggle valve 53 is formed in a generally hourglass shape, including a narrow central stem 53S, a wide upper portion 53U including a first substantially conical sealing face oriented downwardly, and a wide lower portion 53L including a second substantially tapered sealing face oriented upwardly. The jiggle valve 53 is normally oriented with the first substantially conical sealing face abuttingly resting in a valve seat 57 disposed in the hollow portion 56 of the engine side connector 51, as shown in the drawing. During coolant changing/replacing operation, the jiggle valve 53 opens relative to the valve seat 57 when air is sent upwardly from the water jacket 24 into the hollow portion 56 of the engine side connector 51, so that air is sent towards the air bleed tube 48 and out into the atmosphere. It will be understood from FIGS. 5A and 5B that, an opening formed in the valve seat 57 has a diameter which is wider than a diameter of the central stem portion 53S of the valve 53. When the valve 53 is pushed upwardly by air pressure to the position shown in FIG. 5B, the air is allowed to pass between the stem portion and the valve seat 57 because of a gap formed therebetween. When the coolant is thereafter supplied to the water jacket, the jiggle valve 53 closes relative to the valve seat 57.

The air bleed member 47 is screwed into the air bleed hole 46 formed vertically in the protrusion 50 of the sidewall 49 rearward of the cylinder head 19, between the intake ports 21. Accordingly, the air bleed member 47 is disposed such that it longitudinally extends parallel to the axis of the cylinder head 19.

As shown in FIG. 6, the coolant outlet port 43 including a bent portion 58 has an inside diameter D1 which is larger than an inside diameter D2 of the coolant inlet port 41. The connector 45 is formed of a metal. A coolant introductory portion 60 is fluidly connected with a hose communication portion 59 including a tapered inclined portion 61. The inclined portion 61 is formed on an inner peripheral side of the sixth hose 44 which is formed of a rubber.

When the coolant is introduced through the coolant inlet port 41 and delivered to the sixth hose 44 from the coolant outlet port 43, the oil cooler 23 functions to increase fluid pressure by decreasing a flow rate of the coolant because of the inside diameter D1 of the coolant outlet port 43 is greater than the inside diameter D2 of the coolant inlet port 41. The coolant then flows via a piping path throttled down by the inclined portion 61 of the coolant introductory portion 60 in the connector 45 through the sixth hose 44 so as to be smoothed to eventually reach the hose communication portion 59. As such, there is no possibility that any cavitation will occur in the coolant that flows via the oil cooler 23. At the same time, corrosion that would otherwise occur near the bent portion 58 can be prevented. All this contributes to a thinner wall thickness of the pipe, thus enhancing reduction in weight.

In the coolant air bleed structure for the water-cooled internal combustion engine according to the illustrative embodiment of the present invention, as described above, the air bleed member 47 including the jiggle valve 53 is open when air is supplied during a coolant changing/replacing operation to release the air from the engine 16. When the coolant is thereafter fed in (i.e., changed/replaced), the air bleed member 47 is closed and remains closed during normal operation of the vehicle. This eliminates the need for loosening the bolt as required for the conventional air bleed member, thus improving serviceability of the vehicle with regard to routine maintenance thereof.

Further, the air bleed member 47 is disposed at the vertical central portion of the cylinder head 19. As compared with the prior art arrangement, in which the air bleed member is disposed at the upper portion of the cylinder head, the engine 16 can be built compactly vertically and appearance of the engine body can be improved.

In the above-described coolant air bleed structure for the water-cooled internal combustion engine, the air bleed member 47 is disposed between the intake ports of the water-cooled internal combustion engine 16 having the plurality of cylinders with an inclined cylinder axis and the plurality of intake ports 21 disposed on a distal side of the inclination direction. The air bleed member 47 is disposed in the dead space between the ports, which is less noticeable in terms of appearance of the engine. Also, with such disposition of the air bleed member, a compact engine body can be achieved.

In the above-described coolant air bleed structure for the water-cooled internal combustion engine, the air bleed member 47 is disposed in the protrusion 50 formed on the sidewall 49 of the cylinder head 19. The air bleed member longitudinally extends parallel to the axis of the cylinder head 19. The air bleed member 47 is therefore disposed in a position not protruding, i.e., not extending from the sidewall 49 of the cylinder head 19. Therefore, further more compact engine body can be achieved.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A coolant air bleed structure for a water-cooled in-line type internal combustion engine, the water-cooled internal combustion engine comprising a cylinder;

a cylinder head disposed at an upper portion of said cylinder;

an intake port operatively associated with said cylinder; and a water jacket formed within at least the cylinder head; and said coolant air bleed structure comprising:

an air bleed member disposed at a substantially vertical central portion of the cylinder head; said air bleed member comprising a jiggle valve for discharging air from the water jacket;

wherein said vertical central portion is situated on a sidewall of the cylinder head; and wherein said water jacket includes a coolant outlet port formed in the cylinder head, said coolant outlet port opens below the intake port at a left side of the cylinder head;

wherein said air bleed structure is fluidly connected with an upstream side tank of a radiator via an air bleed tube;

wherein said air bleed structure is configured such that during a coolant changing operation, said jiggle valve of the air bleed member is automatically operated to be in an open position to release air from the water jacket;

wherein said substantially vertical central portion includes a protrusion formed thereon, said protrusion having an air bleed hole formed therein; and wherein said air bleed hole is adapted to receive the air bleed member therein.

2. The coolant air bleed structure according to claim 1, wherein the water-cooled in-line type internal combustion engine further includes a plurality of cylinders arranged in a line, each of said cylinders disposed with an inclined cylinder axis at a predetermined degree of inclination; and a plurality of intake ports and exhaust ports disposed on distal sides of the plurality of inclined cylinders;

wherein said air bleed member is disposed between two adjacent of said intake ports.

3. The coolant air bleed structure according to claim 2, wherein said protrusion is formed between two adjacent of said intake ports on the sidewall of the cylinder head, and wherein the air bleed member extends in a longitudinal direction parallel to said sidewall of the cylinder head.

4. The coolant air bleed structure according to claim 1, wherein said protrusion extends outwardly from the sidewall of the cylinder head, and wherein the air bleed member extends in a longitudinal direction substantially parallel to said sidewall of the cylinder head.

5. The coolant air bleed structure according to claim 1, wherein said air bleed member further includes an engine side connector having a hollow opening formed therein; said hollow opening includes a valve seat having said jiggle valve mounted and seated thereon; wherein said jiggle valve is operable to be displaced in relation to the valve seat based on air pressure in said water jacket; and wherein the jiggle valve is formed in a substantially hourglass shape including a narrow central stem, a wide upper portion above the central stem and including a first substantially tapered sealing face oriented downwardly, and a wide lower portion including a second substantially tapered sealing face oriented upwardly.

6. An internal combustion engine comprising a cylinder;

a cylinder head disposed at an upper portion of said cylinder; said cylinder head having a sidewall extending parallel to a cylinder axis;

a coolant jacket formed in said cylinder head; and a coolant air bleed member operatively connected to said coolant jacket;

said coolant air bleed member comprising a valve seat and a jiggle valve operatively mounted on said valve seat; wherein the jiggle valve is formed in a substantially hourglass shape including a narrow central stem, a wide upper portion above the central stem and including a first substantially tapered sealing face oriented downwardly, and a wide lower portion including a second substantially tapered sealing face oriented upwardly;

said coolant air bleed member operable to discharge air from said coolant jacket via displacement of the jiggle valve in relation to said valve seat when air pressure in a coolant jacket is greater than a predetermined value;

wherein said coolant air bleed member is disposed substantially at a vertical central portion of the sidewall of the cylinder head;

wherein said air bleed member is fluidly connected with an upstream side tank of a radiator via an air bleed tube;

wherein said coolant jacket includes a coolant outlet port formed in the cylinder head, said coolant outlet port opens below the intake ports at a left side of the cylinder head;

wherein said substantially vertical central portion includes a protrusion formed thereon, said protrusion having an air bleed hole formed therein; and wherein said air bleed hole is adapted to receive the air bleed member therein; and wherein said air bleed structure is configured such that during a coolant changing operation, said jiggle valve is automatically operated to be in an open position so as to release air from the coolant jacket.

7. An internal combustion engine according to claim 6, wherein said coolant jacket has a liquid coolant therein, said liquid coolant comprising water.

8. An internal combustion engine according to claim 6, wherein said protrusion extends outwardly from said side wall of cylinder head.

9. An internal combustion engine according to claim 6, wherein said coolant air bleed member longitudinally extends parallel to said sidewall of said cylinder head.

10. An internal combustion engine according to claim 6, wherein said coolant air bleed member comprises a solid member having an opening formed therethrough; said valve seat mounted in the opening; said jiggle valve disposed on the valve seat; an engine side connector having a threaded portion formed at one side of the air bleed member, and a tube side connector formed at the other side of the air bleed member.

11. An internal combustion engine according to claim 10, wherein said jiggle valve is configured to be in an open position to release air from said coolant jacket, without loosening a fixing screw of the bleed member, when air is supplied to the coolant jacket during a coolant changing operation.

12. An internal combustion engine according to claim 10, wherein said jiggle valve is in a closed position during a normal operation of the engine.

13. An in-line type internal combustion engine for a vehicle; said engine comprising:

a plurality of cylinders arranged in a line; each of said cylinders having a cylinder axis inclined on a forward side of a vehicle traveling direction;

a cylinder head formed at an upper portion of said cylinders; said cylinder head having a forward sidewall formed at the forward side and a rearward sidewall formed at a rearward side of the vehicle traveling direction;

said rearward sidewall having a plurality of intake ports formed therein;

a coolant jacket formed in said cylinder head;

wherein said coolant jacket includes a coolant outlet port formed in the cylinder head, said coolant outlet port opens below the intake ports at a left side of the cylinder head; and an air bleed member operatively connected to said coolant jacket and to an upstream side tank of a radiator via an air bleed tube;

wherein said air bleed member is disposed on the rearward sidewall of the cylinder head; said air bleed member comprising a valve seat and a jiggle valve operatively mounted on said valve seat;

wherein said valve seat is located at a position above an upper portion of said coolant jacket; and wherein said substantially vertical central portion of the rearward sidewall includes a protrusion formed thereon, said protrusion having an air bleed hole formed therein; and wherein said air bleed hole is adapted to receive the air bleed member therein.

14. An in-line type internal combustion engine according to claim 13, wherein the air bleed member is disposed between two adjacent of said plurality of the intake ports.

15. An in-line type internal combustion engine according to claim 13, wherein said protrusion extends outwardly from the rearward sidewall.

16. An in-line type internal combustion engine according to claim 13, wherein the air bleed member extends longitudinally parallel to the said cylinder axis.

17. An in-line type internal combustion engine according to claim 13, wherein the air bleed member is disposed substantially at a vertical central portion of the rearward sidewall.

18. An in-line type internal combustion engine according to claim 17, wherein the air bleed member includes a longitudinal member having an opening formed therethrough; said valve seat mounted in the opening; said jiggle valve disposed on the valve seat; an engine side connector having threaded portion formed at one side of the air bleed member, a tube side connector formed at the other side of the air bleed member.

19. An in-line type internal combustion engine according to claim 18, wherein said jiggle valve is configured to be in an open position to release air from said coolant jacket, without loosening a fixing screw of the bleed member, when air is supplied to the coolant jacket during a coolant changing operation; and to be in a closed position during a normal operation of the engine.

* * * * *